United States Patent [19]

Watkins

[11] Patent Number: 4,557,209

[45] Date of Patent: Dec. 10, 1985

[54] SCULPTURED HIGH-LOW CUT PILE TUFTING METHOD AND APPARATUS

[75] Inventor: Charles W. Watkins, Ooltewah, Tenn.

[73] Assignee: Tuftco Corporation, Chattanooga, Tenn.

[21] Appl. No.: 630,496

[22] Filed: Jul. 13, 1984

[51] Int. Cl.[4] ..... D05C 15/00

[52] U.S. Cl. ..... 112/266.2; 112/79 R

[58] Field of Search ..... 112/79 A, 79 R, 266.2

[56] References Cited

U.S. PATENT DOCUMENTS

| | | | |
|---|---|---|---|
| 2,800,096 | 7/1957 | Signoret | 112/79 R |
| 2,862,465 | 12/1958 | Card | 112/79 A |
| 3,020,863 | 2/1962 | Smith | 112/79 A |
| 3,075,482 | 1/1963 | Card | 112/79 A |
| 3,108,554 | 10/1963 | Payne et al. | 112/79 R |
| 3,162,155 | 12/1964 | Charles | 112/79 R |
| 3,633,523 | 1/1972 | Card | 112/79 A |
| 3,820,482 | 6/1974 | Woodcock | 112/79 A |
| 4,029,029 | 6/1977 | Franks et al. | 112/79 R |
| 4,301,751 | 11/1981 | Caylor | 112/79 R |
| 4,503,787 | 3/1985 | Watkins | 112/79 |

*Primary Examiner*—Ronald Feldbaum

*Attorney, Agent, or Firm*—Harrington A. Lackey

[57] ABSTRACT

A sculptured high-low cut pile tufting method and apparatus for a multiple-needle tufting machine having cooperating looper hooks and knives in which the base fabric moving through the machine is supported only as it approaches the needles by a needle plate having a transverse free edge substantially in the plane of needle penetration, and does not support the base fabric leaving the needles and directly above the looper hooks. The length of yarns fed to the needles are controlled by a pattern-controlled yarn feed apparatus. When short lengths are fed to the needles, the seized yarn causes the base fabric to be drawn toward the loopers to form short loops which are cut to form low cut pile tufts, while long lengths of yarn fed to the needles form long loops on the looper hooks which are cut to form cut pile tufts while the base fabric maintains its normal longitudinal path through the tufting machine. The apparatus is also characterized by looper hooks of unique construction whose bills have larger rear portions than front portions so that the larger rear portions assist in arresting the longitudinal movement of the short loops on the hook to form low pile.

14 Claims, 9 Drawing Figures

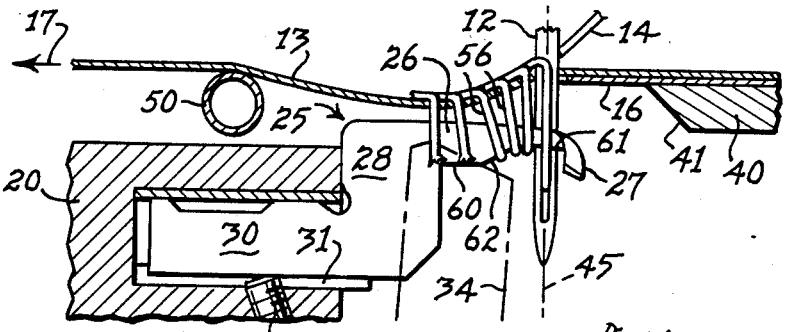
Fig. 3
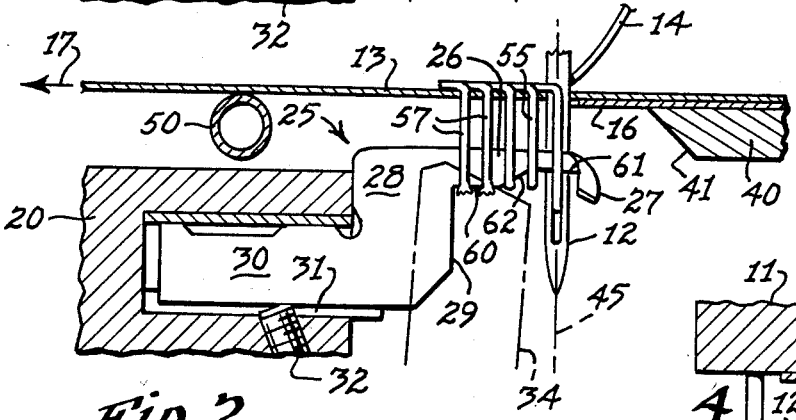
Fig. 2
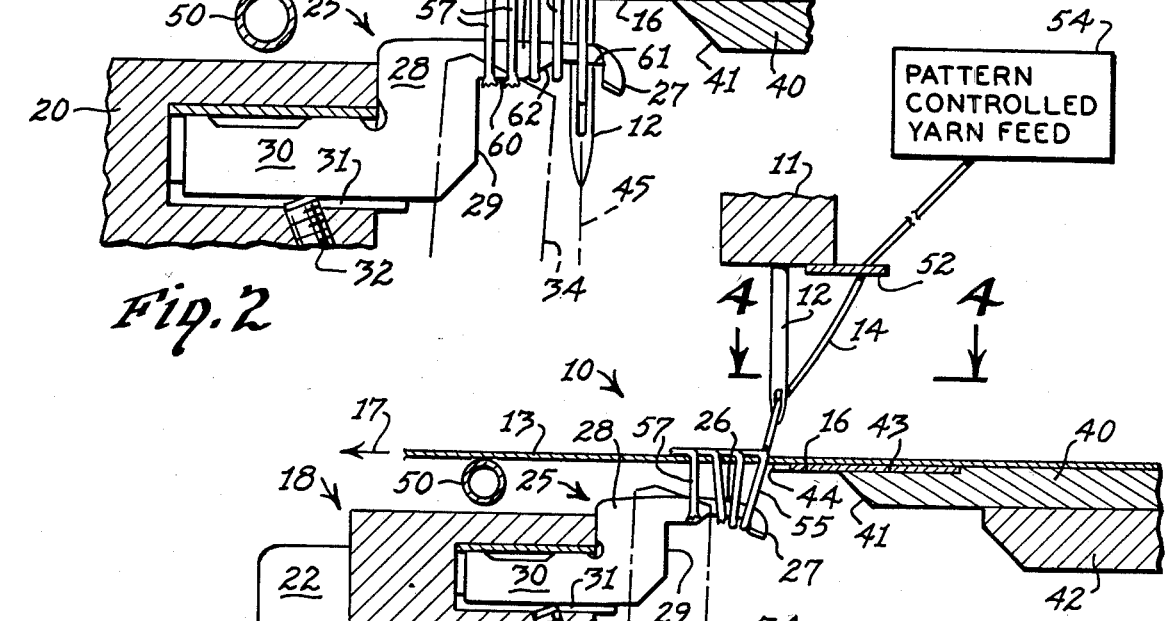
Fig. 1
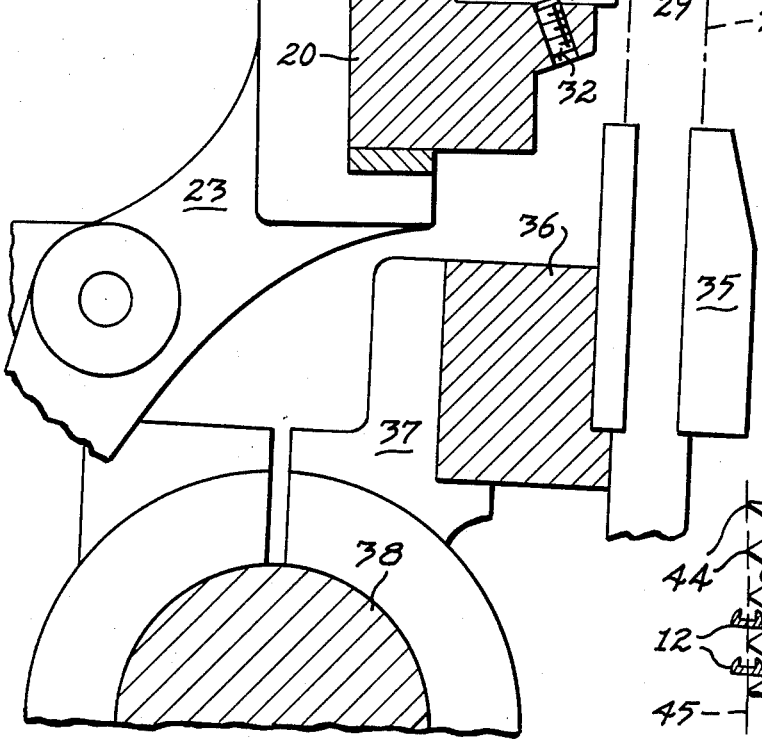
Fig. 4
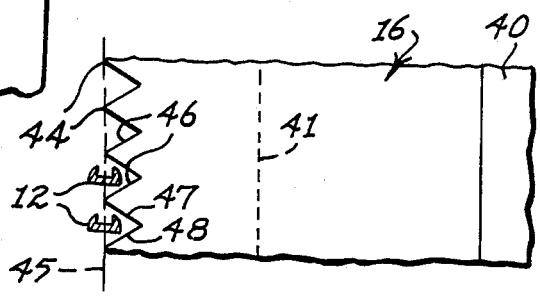

SCULPTURED HIGH-LOW CUT PILE TUFTING METHOD AND APPARATUS

BACKGROUND OF THE INVENTION

This invention relates to tufting machines, and more particularly to a multiple-needle tufting machine adapted to form high and low cut pile tufts in a base fabric.

Heretofore, in the art of tufting, fabric having patterned areas of high cut pile and low cut pile has been formed by cut pile looper hooks, each hook having a pair of vertically spaced bills, the lower bill being provided with a spring clip, as illustrated in U.S. Pat. No. 3,138,126 of Roy T. Card issued June 23, 1964.

These double-billed cut pile hooks were used in cooperation with a pattern controlled yarn feed. When a long length of yarn was fed to the looper, the loop was seized on the lower bill and cut by the cooperating knife to form a high cut pile tuft. When the yarn feed was starved by the pattern control, the yarn loop caught on the lower bill was pulled off of the lower bill, past the yielding spring clip, and subsequently caught upon the upper bill, where it was cut by the same knife. It has been difficult to utilize the double-billed cut pile hook because the same knife must cooperate with both the lower and upper bills to cut all loops formed on both bills.

Another method of forming patterned fabrics having high and low cut pile tufts is to initially produce a fabric having a uniform high cut pile, and then with manual shears carve out selected areas in the cut pile tufts to form patterned low pile tufted areas. This latter method is often used on scatter rugs, bath sets, and other tufted fabrics of relatively small areas, in contrast to large carpets.

SUMMARY OF THE INVENTION

It is therefore an object of this invention to provide a method and an apparatus for forming both high and low cut pile in a tufted fabric with a looper having a single bill.

Another object of this invention is to provide a method and apparatus for forming patterned areas of high and low cut pile in a tufted fabric incorporating gradual transition areas between the high and low cut pile tufts to produce a "soft" sculptured appearance.

In carrying out this invention, a needle plate is utilized which has a transverse free edge terminating at the stitching station, or substantially in the transverse vertical plane of penetration of the needles, so that the needle plate fully supports the base fabric as it moves from front to rear through the machine toward the needles, but provides no support for the base fabric as it moves from the needles toward the rear of the machine and over the major portions of the looper hooks.

In addition to the utilization of the foreshortened needle plate, a conventional pattern-controlled yarn feed mechanism may be utilized to feed two different yarn lengths to the needle to create the respective high cut pile tufts and low cut pile tufts.

A looper apparatus is utilized in combination with the yarn feed control and the foreshortened plate, in which the looper hook has only a single bill to produce both high cut pile and low loop pile.

The cutting knives and the mechanisms for reciprocating the looper hooks in the knives are of conventional construction as normally used in conventional cut pile tufting machines.

As the base fabric moves away from the stitching station and the needle plate, the fabric continues, unsupported, in its normal horizontal path above the looper hooks while the long lengths of yarn are fed to the needles and seized by the looper hooks to form long loops. The knives cooperate with the rear portions of the respective looper hooks in a conventional manner to form high cut pile tufts. However, when the yarn feed is starved by the pattern controls, the yarn is drawn backward or backrobbed through the last loop caught on the looper hook bill to draw or pull down the unsupported base fabric toward the looper hooks to form short loops which are cut approximately mid-way along the looper bill to form low cut pile tufts.

It is also an important feature of this invention to provide single-billed looper hooks in which the rear portions of the bill of each hook is larger in cross-sectional dimension than the front portion. Either the vertical dimension or the transverse dimension of the rear portion of the hook bill is enlarged to further accentuate the differences in height between the long loops and short loops formed on the bill by the back-robbing of the yarn caused by the pattern-controlled yarn feed mechanism. The bills may have a front portion which has an elevated cutting edge relative to the rear portion, or the front portion may be narrower in transverse width or dimension than the rear portion of the looper hook. These front and rear portions of the bills of different dimensions are connected through a gradual merging portion which tends to arrest the rearward movement of the shortened loops until they are cut to form the low cut pile tufts.

BRIEF DESCRIPTION OF THE DRAWINGS

FIG. 1 is a fragmentary sectional elevation of a portion of a multiple-needle tufting machine incorporating the invention and disclosing the hooks and knives in a cutting position;

FIG. 2 is an enlarged fragmentary sectional elevation similar to FIG. 1, disclosing the hooks cooperating with the needles in a non-cutting position to form long loops;

FIG. 3 is a view similar to FIG. 2 illustrating the formation of the low loops;

FIG. 4 is an enlarged fragmentary sectional view taken along the line 4—4 of FIG. 1;

DESCRIPTION OF THE PREFERRED EMBODIMENTS

Figure 5:
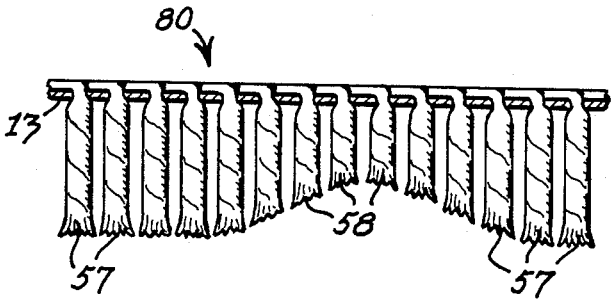
FIG. 5 is an enlarged fragmentary vertical section taken through a fabric made in accordance with this invention.

Referring now to the drawings in more detail, FIG. 1 discloses a multiple-needle tufting machine 10 including a transverse needle bar 11 supporting a transversely aligned row of uniformly spaced, vertical needles 12. The needle bar 11 is vertically reciprocated by conventional means, not shown, to cause the needles 12 to move between an upper position (FIG. 1) above the base fabric 13 and a lower position (FIG. 2) penetrating the base fabric 13, so that each needle 12 will carry a yarn 14 through the base fabric 13 to form loops of tufting therein.

The base fabric 13 is supported upon the needle plate 16, made in accordance with this invention, for movement by conventional fabric rolls, not shown, such as the fabric feed rolls illustrated in the Card U.S. Pat. No. 3,138,126, in the direction of the arrow 17, that is longitudinally from front-to-rear through the machine 10.

The looper apparatus 18 which cooperates with the needles 12 includes a transverse hook bar 20 supported upon a plurality of transversely spaced brackets 22 fixed to corresponding rocker arms 23, journaled on a conventional rock shaft, not shown. The rock shaft is driven by conventional means, not shown, connected to the rocker arms 23 for limited reciprocable movement in synchronism with the reciprocable movement of the needles 12.

Supported within the hook bar 20 are a plurality of transversely spaced cut pile looper hooks 25. Each looper hook 25 includes a bill 26 having a barbed free end 27 pointing in the direction opposite the direction of fabric feed. The bill 26 projects from the neck 28 to form the throat 29. Projecting rearwardly from the neck 28 is the shank 30 received within the recess 31 of the hook bar 20, and secured therein by the set screws 32.

A knife 34 is provided for each looper hook 25 to cooperate with the corresponding hook 25 to produce cut pile tufts. The knives 34 may be mounted in knife blocks 35 carried upon a transverse knife bar 36, which in turn is carried by the arms 37 mounted on the reciprocably driven rotary knife shaft 38. The knife shaft 38 and the means for driving the hook bar 20 and the needle bar 11 are all driven synchronously by means well known in the art to cause the needles 12, the looper hooks 25 and the knives 34 to cooperate to form cut pile tufts from the yarns 14.

The needle plate assembly, including one or more needle plates 16, may be identical to the needle plate assembly disclosed in applicant's co-pending patent application Ser. No. 538,944 for "LOW PILE NEEDLE PLATE FOR A TUFTING MACHINE", filed Oct. 4, 1983 and issued on Mar. 12, 1985 as U.S. Pat. No. 4,503,787. In this co-pending application, a plurality of needle plates 16, or needle plate sections, are arranged end-to-end transversely of the tufting machine 10. Each needle plate 16 is preferably made of a rectangular sheet of unitary solid material, such as spring steel, of very thin gauge or thickness. Each needle plate 16 is mounted upon an elongated mounting plate 40 having a rear edge 41 and adapted to be supported upon the bed plate 42 of the machine 10.

Preferably, the rear top portion of the mounting plate 40 includes a recess 43 to receive the front portion of each needle plate 16, so that the free rear or trailing edge 44 of the needle plate 16 extends transversely of the machine 10 and terminates substantially in the transverse vertical plane 45 of penetration of the needles 12, that is the plane containing the vertical needle axes. In FIG. 4, the free rear edge 44 of the needle plate 16 is illustrated as substantially intersecting the transverse vertical plane 45 containing the needle axes or paths. This transverse vertical plane 45 of needle penetration may also be referred to as the stitching station.

The free rear edge 44 of the needle plate 16 is also spaced rearwardly of the rear edge 41 of the mounting plate 40 to provide clearance for the forward movement of the looper hooks 25 beneath the needle plate 16.

The needle plate 16 may be secured in the recesses 43 by any conventional securing means such as spot welds, so that the top surface of the needle plate 16 is flush with the top surface of the mounting plate 40 to provide a co-planar surface over which the base fabric 13 is supported and may be moved.

A plurality of open notches 46, preferably of uniform size and transverse spacing, may be formed in the trailing edge 44 of the needle plate 16. Each notch 46 is large enough to accommodate, that is to receive, a needle 12, as it penetrates the base fabric 13. The edges 47 and 48 of each notch 46 are spaced as closely as possible to a corresponding needle 12 to support the maximum area of the base fabric 13 adjacent the corresponding needle 12, without interfering with the movement of the respective needles 12.

As disclosed in FIG. 4, the notches 46 are V-shaped and diverge symmetrically about the longitudinal median of the angular notch 46, which median coincides with the center of each corresponding needle 12.

The diverging side walls 47 and 48 open through the trailing edge 44 of the needle plate 16 to provide ample room for the exit of each tufted loop formed on the corresponding needle 12.

Spaced behind, and in substantially the same horizontal plane as the needle plate 16, is a transverse lifter bar 50, which also supports the base fabric 13 as it moves rearwardly through the machine 10. The lifter bar 50 is spaced behind the bills 26 of the looper hooks 25 and may be located above the transverse hook bar 20.

Thus, as best disclosed in FIGS. 1, 2 and 3, the needle plate 16 provides a solid support for that portion of the base fabric 13 in the front of the machine 10 moving toward the needles 12, but provides no support for any portion of the base fabric moving from the needles 12, or the stitching station, rearward. Only the lifter bar 50 supports the rear portion of the base fabric 13. Of course, tension is maintained in the base fabric 13 by the fabric feed rolls, not shown, in the front and rear of the machine 10.

Thus, the construction of the needle plate 10 is important to the function of this invention and must have a free rear edge 44 which terminates in the vicinity of the needles 12, or the stitching station, so that the base fabric 13 is unsupported above the bills 26 of the looper hooks 25.

The yarns 14 are fed to the respective needles 12 through a conventional yarn guide 52, fixed to the needle bar 11, from a pattern-controlled yarn feed mechanism 54, of any conventional type, such as that disclosed in the prior U.S. Pat. No. 3,084,645.

The pattern-controlled yarn feed apparatus 54, shown schematically in FIG. 1, is adapted to selectively reduce the speed of the yarns 14, fed to the corresponding needles 12 in order to starve the yarn feed, and feed a short length of yarn to the corresponding looper hook 25. Thus, after a long loop 55 is formed upon a bill 26, and additional tension is created in the yarn 14 fed to that particular hook 25, then the tensioned loop 55 is backdrawn, pulling the unsupported portion of the base fabric 13 downward, as disclosed in FIG. 3, to form a short loop 56.

When the pattern-controlled yarn feed apparatus 54 is programmed to feed a normal or long length of yarn 14, the loop 55, seized by the bill 26 of the looper hook 25, will be long enough not to create any tension in the yarn loop 55 or the base fabric 13.

Accordingly, the long loop 55 will continue travelling rearwardly along the looper bill 26 toward the throat 29, where it will be cut by the normally reciprocating knife 34 to form a long cut pile tuft 57 (FIGS. 2 and 5).

The foreshortened or short loop 56, illustrated in FIG. 3, will be retarded in its rearward movement, but will still be permitted to enter the normal reciprocable cutting path of the knife 34, to be cut about mid-way between the barbed end 27 and the throat 29 to form a short cut pile tuft 58 (FIG. 5).

In this manner, a fabric 80 including high cut pile tufts 57 and low cut pile tufts 58, may be formed by a looper apparatus 18 in which each looper hook 25 has only a single bill 26.

In order to accentuate the dual heights of the cut pile, looper hooks of varying configurations may be utilized.

The looper hook 25 disclosed in FIGS. 1–3 differs from the conventional cut pile looper hook in the configuration of the lower or bottom cutting edge of the bill 26. The vertical thickness or height of the rear portion of the bill 26 is substantially greater than the corresponding vertical dimension of the front portion of the bill 26, so that the rear cutting edge portion 60 has a greater uniform depth than the front cutting edge portion 61. The cutting edge portions 60 and 61 may be joined by a forward and upward inclined shoulder or merging portion 62. The depth of the rear cutting edge portion 60 is such that when the looper hook 25 is set at its desired position below the plane of the needle plate 16, the long loops 55, seized by the looper hook 25 and formed by the long lengths of yarn 14 fed by the pattern-controlled yarn feed apparatus 54, will be long enough to pass rearwardly over the rear cutting edge portion 60 with a minimum of tension, so that the base fabric 13 remains in its normal plane of movement, as illustrated in FIG. 2. As the long loops 55 travel freely over the rear cutting edge portion 60, they are cut by the normal movement of the knife 34, to form the long cut pile 57.

However, when the yarn 14 is starved and short lengths of the yarn 14 are fed to the needles 12 and seized by the looper hook 25, the rearward movement of the short loops 56 are restrained by the merging portions 62. Continued rearward movement of the base fabric 13 and the short loops 56, strains the yarn in the short loops 56 to cause the unsupported base fabric 13 to be pulled downward toward the looper hook 25, as disclosed in FIG. 3, until the taut short loops 56 are severed by the normal reciprocal movement of the knife 34 crossing the merging zone 62, to create the short cut pile tufts 58.

Accordingly, it is critical that the merging zone 62 of the bill 26 be located in the path of the vertically reciprocable knife 34, so that the short loops 56 are eventually cut.

Each merging zone 62 also tapers gradually to guide the long-loops 55 rearward over the deeper rear cutting edge portion 60.

Figure 6:
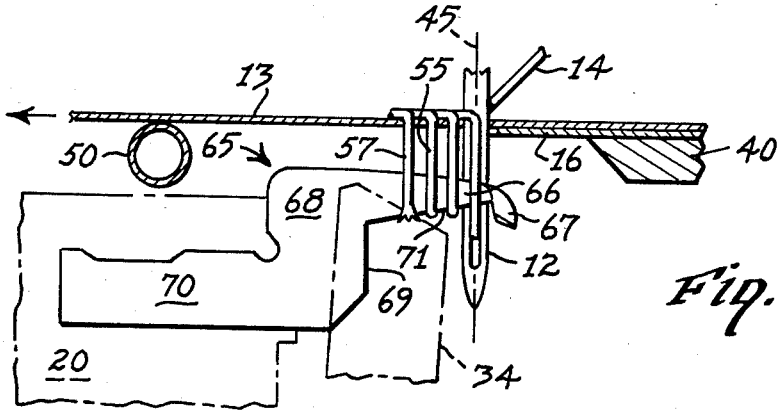
FIG. 6 is a view similar to FIG. 2, illustrating a first modified form of looper hook.

FIG. 6 discloses a modified looper hook 65 incorporating a bill 66 having a free front barbed end 67, neck 68, throat 69 and shank 70 received within the transverse hook bar 20. The lower or bottom cutting edge 71 of the bill 66 differs from the cutting edge portions 60–62 of the looper hook 25, in that the cutting edge 71 is in a generally straight line, but inclining upward and forward to create the differences in elevation between the rear portion and the front portion of the bill 66. Thus, the looper hook 65 functions in substantially the same way as the looper hook 25. Long loops 55 will travel un-interruptedly rearwardly along the bill 66 until the long loops 55 are cut by the vertically reciprocal knife 34. However, any short loops 56, not shown, in FIG. 6, will gradually meet resistance from the declining cutting edge 71 to create tension in the short loop 56 and pull the base fabric 13 downward, in the same manner as it is pulled downwardly in FIG. 3, until that short loop can be cut to form the short cut pile tufts 58.

Figure 8:
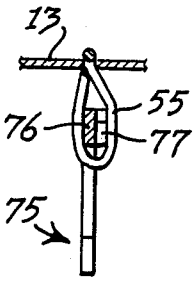
FIG. 8 is a fragmentary section taken along the line 8—8 of FIG. 7.
Figure 7:
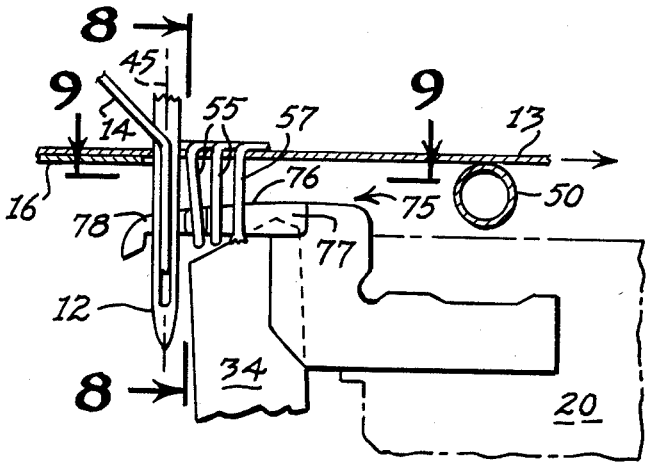
FIG. 7 is a fragmentary sectional elevation similar to FIG. 2, but taken from the opposite side, illustrating a second modified looper hook.
Figure 9:
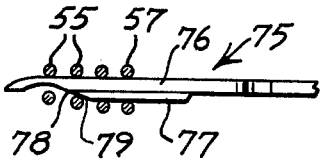
FIG. 9 is a fragmentary section taken along the line 9—9 of FIG. 7.

FIGS. 7–9 disclose another modified form of looper hook 75 having a bill 76, in which the rear portion 77 of the bill 76. has a substantially greater width or transverse dimension than the front portion 78 of the bill 76. In a preferred form of the invention, the enlarged rear portion is formed by securing a steel pad 77 by soldering or otherwise, to the needle side of the bill 76. This pad 77 is provided with a forward tapering portion 79 (FIG. 9) to provide a gradual transition area for the rearward movement of the loops. This transitional or inclined area 79 is positioned to hold each short loop 56, not shown in FIGS. 7–9, in the path of the knife 34, by providing a barrier to prevent the rearward movement of the short loop along the bill 76, thereby creating sufficient tension to draw down the base fabric 13 in the manner disclosed in FIG. 3.

In the looper hook 75 disclosed in FIGS. 7, 8 and 9, the bottom cutting edge of the looper hook 75 may be straight and substantially level, since the transverse dimension of the rear portion 77 has been enlarged to perform the same function as the deeper rear cutting edge portions of the looper hooks 65 and 25.

In each of the tufting machines or apparatus in which the modified looper hooks 65 or 75 are utilized, the other portions of the tufting machine 10 are the same. In each case, the needle plate 13 must have a free edge portion 44 which terminates in the plane 45 of the needle penetration so that the rear portion of the base fabric 13 over the looper hooks is unsupported and thereby is free to be drawn downward toward the looper hooks to form the low cut pile tufts.

Because of the gradual retardation of the rearward movement of the short loops along the bills of the respective looper hooks, the transition between the formation of the high cut pile tufts 57 and the low cut pile tufts 58 is gradual, as clearly illustrated in FIG. 5. This gradual transition between the high and low cut pile areas of selected pattern configurations in the tufted fabric, such as a carpet, creates a unique and pleasing sculptured effect in the finished fabric. Of course, the sculptured areas are controlled by the program instructions in the pattern control yarn feed apparatus 54 so that patterns of infinite designs in high and low tufted cut pile fabrics are possible.

Also, because of the relatively thin needle plates 13, the looper hooks 25, 65 and 75 may be located quite close to the path of the moving base fabric 13 to create both high cut and low cut pile tufts of relatively short depths.

A tufted cut pile fabric, such as the fabric 80 disclosed in FIG. 5, has been tufted in which the low cut pile tufts 58 are approximately ¼" high and the high cut pile tufts 57 are approximately 15/32" high, with a difference in height of approximately 7/32". Such a fabric, with its gradual transition areas presents an image of soft and smooth wave-type pile surfaces.

I claim:

1. The method of tufting high and low cut pile in a base fabric moving longitudinally in a normal path, comprising the steps of:

(a) stitching a series of yarn loops at a stitching station successively through the base fabric as the base fabric moves longitudinally, (b) seizing each yarn loop with a looper hook as the loop is stitched, (c) successively cutting each yarn loop upon the looper hook, (d) supporting the base fabric only as it moves toward the stitching station and at the stitching station, to provide an unsupported portion moving away from said stitching station, (e) selectively feeding a short length or a long length of yarn to the stitching station so that when a short length of yarn is seized, the unsupported portion of the base fabric is drawn toward the looper hook to create a short loop, and when a long length of yarn is seized, the base fabric remains in its normal path to create a long loop.

2. The method according to claim 1 in which the stitching step is carried out by a plurality of transversely aligned needles adapted to reciprocate vertically through the base fabric at the stitching station.

3. The method according to claim 1 in which the step of seizing each yarn loop comprises reciprocably moving a looper hook having a bill toward and away from the stitching station below the unsupported portion of the base fabric to cause said bill to seize each yarn loop.

4. The method according to claim 3 in which the step of cutting each yarn loop comprises reciprocably moving a knife across the looper hook to cut all loops seized by the looper hook in the path of the knife, so that the short lengths of yarn loops are cut in a position closer to the stitching station than the long lengths of yarn loops are cut.

5. In a multiple-needle tufting machine, having a transverse row of needles reciprocating in vertical needle paths for carrying yarn through a base fabric moveable longitudinally in a normal path through the machine, an apparatus for forming high and low cut pile, comprising:

(a) a looper hook for each needle having a bill for seizing and forming a loop in each yarn carried through the base fabric by the corresponding needle, (b) a needle plate mounted in the tufting machine and adapted to support only the portion of the base fabric moving toward the needle paths, said needle plate having a free transverse edge terminating adjacent the paths of the needles to provide an unsupported portion of said base fabric moving away from the needle plate, (c) means for selectively feeding a short length or a long length of a yarn to each of said needles so that when a short length of yarn is seized by said bill said unsupported portion of the base fabric is drawn toward the looper hook to create a short loop on said bill, and when a long length of yarn is seized by said bill, the base fabric remains in its normal path to create a long loop on said bill, and (d) a knife cooperating with each looper hook to cut each corresponding loop on said bill.

6. The invention according to claim 5 in which said free edge of said needle plate terminates substantially in the transverse plane of the penetration of the base fabric by the needles.

7. The invention according to claim 6 further comprising a plurality of notches formed in said free transverse edge, there being one notch for receiving each needle as the needles penetrate the base fabric, said notches opening in the direction of the fabric feed.

8. The invention according to claim 6 further comprising means for reciprocably moving said looper hooks to an operative position in which each bill crosses a corresponding needle penetrating the base fabric to seize and form a loop in the yarn carried by the corresponding needle, and to an inoperative position withdrawn from the transverse plane of penetration and on the opposite side of said plane of penetration from said needle plate so that said withdrawn looper hooks are beneath the unsupported portion of the base fabric.

9. The invention according to claim 8 in which the base fabric is moved longitudinally rearward, said needle plate is mounted in front of the transverse plane of penetration, said looper hooks point forward, and said means for reciprocably moving said looper hooks move said looper hooks between a rearward inoperative position and a forward operative position.

10. The invention according to claim 9 further comprising means for reciprocably moving said knives to cooperate with said corresponding looper hooks to form cut pile tufts in said inoperative position, whereby said long loops are cut on the rear portion of each of said corresponding bills and each of said short loops is cut in front of said long loops on the same corresponding bill.

11. The invention according to claim 10 in which each said bill comprises a lower cutting edge having a rear portion and a front portion elevated above said rear portion to facilitate the arresting of the rearward movement of said short loops prior to cutting of said short loop.

12. The invention according to claim 11 further comprising a forward and upward sloping shoulder connecting said rear and front portions of said cutting edges, whereby the rearward movement of said short loops is arrested by said shoulder.

13. The invention according to claim 11 in which said lower cutting edge of the bill of each looper hook slopes upward and forward.

14. The invention according to claim 10 in which each said bill has a rear portion which is substantially transversely wider than the front portion of said bill to facilitate arresting the rearward movement of a short loop on said bill until said short loop is cut.

* * * * *